United States Patent [19]

Yamamoto et al.

[11] Patent Number: 4,756,963

[45] Date of Patent: Jul. 12, 1988

[54] PROTECTIVE MEMBER AND PRINT PROTECTION METHOD USING THE SAME

[75] Inventors: Mayumi Yamamoto, Nihonbashi; Eiichi Suzuki, Itabashi; Reiko Yanagiba, Kawasaki; Shigeo Toganoh, Tokyo; Toshiaki Kimura, Sagamihara, all of Japan

[73] Assignee: Canon Kabushiki Kaisha, Tokyo, Japan

[21] Appl. No.: 904,452

[22] Filed: Sep. 8, 1986

[30] Foreign Application Priority Data

Sep. 10, 1985 [JP] Japan ..... 60-198681

[51] Int. Cl.[4] ..... B41M 5/00

[52] U.S. Cl. ..... 428/334; 428/195; 428/335; 428/336; 428/354; 428/484; 428/488.1; 428/690; 428/913; 428/914

[58] Field of Search ..... 428/195, 207, 211, 484, 428/488.1, 488.4, 690, 691, 913, 914, 334–336, 354; 156/230, 234, 239, 240, 247, 277

[56] References Cited

U.S. PATENT DOCUMENTS

| | | | |
|---|---|---|---|
| 2,264,295 | 12/1941 | Carter | 129/16.7 |
| 3,547,753 | 12/1970 | Sutton | 161/160 |
| 3,549,447 | 12/1970 | Bresnick | 156/230 |
| 3,690,983 | 9/1972 | Claeys | 156/230 |
| 3,874,984 | 4/1975 | Newman | 161/117 |
| 4,060,441 | 11/1977 | Ohta et al. | 156/234 |
| 4,211,839 | 7/1980 | Suzuki et al. | 430/353 |
| 4,241,155 | 12/1980 | Hara et al. | 430/559 |
| 4,378,392 | 3/1983 | Segel | 428/40 |
| 4,517,283 | 5/1985 | Leppard et al. | 430/372 |
| 4,521,785 | 6/1985 | Matsufuji | 346/25 |
| 4,558,129 | 12/1985 | Ikenoue et al. | 430/353 |
| 4,565,730 | 1/1986 | Poth | 428/204 |
| 4,595,316 | 6/1986 | Toganoh et al. | 346/1.1 |

FOREIGN PATENT DOCUMENTS

| | | | |
|---|---|---|---|
| 0142890 | 8/1983 | Japan | 428/195 |

*Primary Examiner*—Bruce H. Hess

*Attorney, Agent, or Firm*—Fitzpatrick, Cella, Harper & Scinto

[57] ABSTRACT

A protective member is provided which comprises a substrate and a transfer layer provided releasably thereon, the transfer layer comprising at least a fluorescent whitening agent, an ultraviolet light absorber, and a light stabilizer. A method for protecting a print having an image formed from a dye is also provided. The method comprises a step of laminating and contact-bonding said protecting member on a surface of a side of the image of the print, and step of releasing the above-mentioned substrate from the laminated picture.

20 Claims, 1 Drawing Sheet

PROTECTIVE MEMBER AND PRINT PROTECTION METHOD USING THE SAME

BACKGROUND OF THE INVENTION

1. Field of the Invention

The present invention relates to a protective member for laminating a print formed by recording an image on paper and the like by a recording process employing a recording liquid, especially an ink jet recording process, and the present invention also relates to a method for protecting the print.

2. Description of the Related Art

The ink jet recording process conducts recording by ejecting droplets of a recording liquid through an orifice on a recording head and depositing these droplets on recording medium such as paper. This recording method is drawing much attention since it produces less noise, requires no particular fixing process and enables high-speed and full-color recording.

The recording liquid used in this ink jet recording method generally comprises a recording agent such as a dye and a solvent. The solvent may be either water or a mixed solvent of water and other solvents.

Since the ink jet recording method uses an aqueous recording liquid, the recording media are required to have an excellent ability for absorption and fixing of a recording liquid. In multi-color ink jet recording which uses more than two colors of recording liquids, the absorption and fixing qualities are important because of the increased amount of recording liquids depositing on the recording media.

Recording media excellent in these qualities are produced by forming on the substrate such as paper a receiving layer for recording liquids which is constituted of a porous material having good absorption and fixing qualities.

However, in prints produced by the ink jet recording method, recorded images do not always have adequate resistance to water, solvents, abrasion, etc. because aqueous dyes are mainly used as recording agents. Furthermore, most dyes used as a recording liquid ingredient do not have a satisfactory resistance to continuous or intermittent prolonged light exposure, so that images formed from such dyes are subject to discoloring and fading.

Aqueous recording liquids also contain a less volatile ingredient, and drying and fixing of recorded images require some time.

Meanwhile, in a recording medium with a porous receiving layer for a recording liquid, the surface of recording medium lacks glossiness, and even when an image is recorded sharply, the sharpness as observed visually will be impaired. This disadvantage was one of the major problems that must be solved when multi-color images are recorded for producing color prints by the ink jet recording method.

SUMMARY OF THE INVENTION

An object of this invention is to provide a protective member suitable for lamination treatment on an image with a resin that can easily provide good light-resistance, as well as resistance to water, solvents, abrasion, etc., to a recorded image of a print formed by a dye-containing recording liquid, and a print protecting method using this print protective member.

Another object of this invention is to provide a print protective member and a print protective method using this member that can give gloss to a recorded image of the print, thereby improving the quality of the recorded image.

Still another object of this invention is to provide a print protective member and print protecting method using this member that can give gloss to a recorded image of a print to adjust the whiteness of recording media to a suitable level, thereby improving the quality of the recorded image.

A further object of this invention is to provide a print protective member and a print protective method using this member that allows lamination of a recorded image on the surface of prints, i.e. only one surface side of prints, without causing the print to curl.

All these objects can be accomplished by the invention which will be described below.

According to an aspect of the present invention, there is provided a protective member comprising a substrate and a transfer layer provided releasably thereon, said transfer layer comprising at least a fluorescent whitening agent, an ultraviolet light absorber, and a light stabilizer.

According to another aspect of the present invention, there is provided a print protective method for protecting a print having an image formed from a dye by employing a protective member comprising a substrate and a transfer layer provided releasably on the substrate, said method comprising the steps of laminating and contact-bonding said protecting member on a surface of the picture of the print, and a step of releasing said substrate from the laminated image, said transfer layer containing at least an ultraviolet light absorber, a light stabilizer, and a fluorescent whitening agent.

DETAILED DESCRIPTION OF THE PREFERRED EMBODIMENTS

Figure 1:
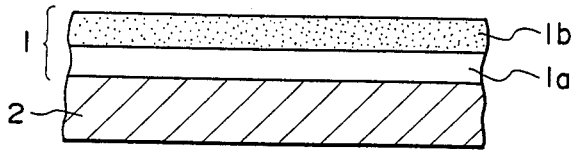
FIGS. 1 and 2 are cross-sectional views of an embodiment of the protective member of the invention.

The protective member of the invention will be described below in detail by referring to the drawings.

Functionally, the protective member of the invention comprises transfer layer 1 and substrate 2 which bears the transfer layer. The transfer layer is transferred and laminated over a surface (a recorded image surface) which carries an image of print formed by a recording liquid.

FIG. 1 shows a cross section of an embodiment of the protective member of the invention. The cross section shows that the transfer layer consists of two layers: one layer contains a fluorescent whitening agent and the other layer contains a light stabilizer and an ultraviolet light absorber. In this protective member, transfer layer 1 consists of layer 1*a* which contains the fluorescent whitening agent and layer 1*b* which contains the light stabilizer and the ultraviolet light absorber. Layer 1*a* is supported by substrate 2 in such a manner that it may readily be peeled off from substrate 2 when transfer layer 1 has been transferred and laminated over a recorded image surface.

Figure 2:
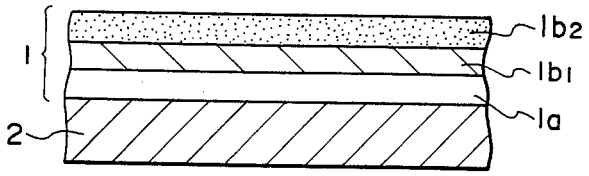

The type of the protective member of the invention is not limited to that shown in FIG. 1. In case the light stabilizer and the ultraviolet light absorber are not compatible with each other, transfer layer 1 may be made up of, for example, three layers as shown in FIG. 2. Referring to this figure, layer 1*a* contains the fluorescent whitening agent, layer 1*b*1 the ultraviolet light absorber, and layer 1*b*2 the light stabilizer. In any case, the layer farthest from the substrate should contain at least the light stabilizer while no layer other than the one containing the fluorescent whitening agent should be positioned closer to the substrate or, if it is so positioned, it should contain no ultraviolet light absorber. Transfer layer 1 is laid over the print in such manner as to directly cover the recorded images to be laminated, while being supported by substrate 2 as described above. The transfer layer is then attached to the recorded image surface by pressure and/or a fusion process and adhered on the surface to serve as a protective layer for the recorded image surface. Substrate 2 is peeled off from the transfer layer after the latter has been applied over the recorded image surface. Consequently, only transfer layer 1 remains on the recorded images as its protective layer.

Transfer layer 1 may take various shapes and sizes according to the shape and size of images which this layer will cover. Meanwhile, substrate 2 should have at least a shape and size sufficient to support transfer layer 1.

The substrate for the protective layer of the invention may be obtained by applying a releasing agent such as silicone resin to paper, cloth, plastic film, etc. Alternatively, films such as Mylar (trade name) film and polypropylene film which have releasing characteristics against the transfer layer may be used as will be described below.

As described above, transfer layer 1 can be laid over the surface of images and can provide the images resistance to water, solvents, and abrasion. This layer is constituted mainly, by a thermoplastic resin such as ethyl cellulose, vinyl acetate resin, and their derivatives, polystyrene polyethylene, ethylene-vinyl acetate copolymers, acrylic resins, polystyrene and their copolymers, polyisobutylene, hydrocarbon resins, polypropylene, polyamide resins and polyester resins. In forming layer 1*b* which is provided farthest from the substrate and contains a light stabilizer, the constituting material is selected so as to obtain sufficient adhesion on the recorded picture surface.

The surface of the recorded image will be made glossy, if the transfer layer contacting the substrate is formed so that the external surface of the transfer layer will exhibit gloss after substrate 2 is released. Furthermore, each individual layer of transfer layer 1 may contain other additives such as wax, a plasticizer, a tackifier and an antioxidant.

The protective member of the invention as described above may be formed by laminating on the substrate the constituting layers, using a coating process such as bar coat, blade coat, reverse roll coat and gravure roll coat processes.

The protective member of the invention is suited for lamination of only one side of the print (the image-bearing side). Therefore, in the event that its transfer layer is applied onto the print by a thermal process, this layer should be prepared so that its shrinkage ratio due to its change in temperature after the thermal process wil be about the same as the shrinkage ratio of the print, and will not cause the laminated print to curl.

The ultraviolet absorber to be used in the transfer layer of the protective member of the invention should be capable of absorbing light mainly in a 300 to 380 nm region from the light penetrating the transfer layer when this layer functions as a protective layer for the image. The light in this wavelength range is mainly responsible for decomposition and deterioration of dyes used as recording agents in recording liquid, thereby discoloring, fading or bleaching the image. The following compounds can be cited as suitable ultraviolet absorbers: 2,2'-dihydroxy-4-dimethoxybenzophenone such as Cyasorb UV-24 (trade name supplied by ACC); benzophenone compounds such as 2,2'-dihydroxy-4,4'-dimethoxybenzophenone, for example, Uvinul D-49 (trade name, a product of BASF); 2-(2'-hydroxy-5'-methylphenyl)benzotriazole, for example Tinuvin P (trade name, a product of Ciba Geigy); 2-(2'-hydroxy-5'-tert-butylphenyl)benzotriazole, for example Tinuvin PS (trade name, a product of Ciba Geigy); 2-(2'-hydroxy-3',5'-di-tert-butylphenyl) benzotriazole, for example Tinuvin 320 (trade name, a product of Ciba Geigy); 2-(2'-hydroxy-3'-tert-butyl-5'-methylphenyl)-5-chlorobenzotriazole, for example Tinuvin 326 (trade name, a product of Ciba Geigy); 2-(2'-hydroxy-3',5'-di-tert-butylphenyl)-5-chlorobenzotriazole, for example, Tinuvin 327 (trade name, a product of Ciba Geigy); 2-(2'-hydroxy-3',5'-di-tert-amylphenyl)benzotriazole, for example, Tinuvin 328 (trade name, a product of Ciba Geigy); 5-tert-butyl-3-(5-chloro-2H-benzotriazole-2-yl)-4-hydroxybenzenepropionic acid octyl ester, for example Tinuvin 109 (trade name, a product of Ciba Geigy); benzotriazole compounds such as 2-(2'-hydroxy-3',5'-di(1,1-dimethylbenzyl)phenyl)-2H-benzotriazole, for example Tinuvin 900 (trade name, a product of Ciba Geigy); phenyl salicylate, for example, Seesorb 201 (trade name, a product of Nisseki Calcium); p-tert-butylphenyl salicylate, for example, Sumisorb 90 (trade name, a product of Sumitomo Chemical); and salicyclic acid compounds such as p-octylphenyl salicylate, for example OPS (trade name, a product of Eastman Chemical).

Referring to layer 1*b* of the transfer layer in FIG. 1, it is desirable that this layer 1*b* contain about 0.5 to 12.0 weight % of an ultraviolet light absorber as described above, preferably about 1.0 to 10 weight % based on the resin constituting the layer containing the ultraviolet absorber. Layer 1*b* in FIG. 2 should preferably contain about 0.5 to 12.0 weight %, more preferably 1.0 to 10 weight %.

If the ultraviolet light absorber content is 0.5 weight % or less, the effect of the absorber on suppressing the fading of dyes will be extremely small. In case the content exceeds 12 weight %, the compatibility with the resin will drop and the absorber tends to separate. This may impair the sharpness of the pictures.

The light stabilizer contained in the transfer layer of the protective member of the invention will substantially improve the resistance of images to the damaging effects of light mainly by deactivating radicals (for example, hydroperoxide radicals, HOO., etc.) which are formed in the transfer layer and/or the surface layer of recording medium (the dye-containing layer) by light not absorbed by the aforementioned ultraviolet light absorber, or due to some other causes. This deactivation occurs in the transfer layer and in the surface layer of the recording medium into which the transfer layer has penetrated at the time of lamination.

The following compounds are mentioned as the light stabilizers (radical scavengers): bis-(2,2,6,6-tetramethyl-4-piperidyl)sebacate, for example Sanol LS 770 (trade name, a product of Ciba Geigy); bis-(1,2,2,6,6-pentamethyl-4-piperidyl) sebacate, for example Sanol LS 765 (trade name, a product of Ciba Geigy); succinic acid dimethyl-1-(2-hydroxyethyl)-4-hydroxy-2,2,6,6-tetramethyl piperidine polycondensate, for example Sanol LS622LD (trade name, a product of Ciba Geigy); poly [[6-(1,1,3,3-tetramethylbutyl)imino-1,3,5-triazine-2,4-diyl]-[(2,2,6,6-tetramethyl-4-piperidyl)imino] hexamethylene [(2,2,6,6-tetramethyl-4-piperidyl)imino]], for example Sanol LS944LD(DF) (trade name, a product of Ciba Geigy); and hindered amine compounds such as 2-(3,5-di-tert-butyl-4-hydroxybenzyl)-2-n-butyl malonic acid-bis-(1,2,2,6,6-pentamethyl-4-piperidyl), for example, Tinuvin 144 (trade name, a product of Ciba Geigy).

With respect to the content of the aforementioned light stabilizer, layer 1b of the transfer layer shown in FIG. 1 should preferably contain about 0.01 to 1 weight % of the light stabilizer, more preferably about 0.1 to 0.5 weight % of the resin constituting the layer containing the light stabilizer. Layer 1b2 in FIG. 2 should preferably contain about 0.01 to 0.5 weight % of the light stabilizer, more preferably about 0.1 to 0.5 weight %.

If the amount of the light stabilizer is less than 0.01 weight %, the effect of the stabilizers on inhibiting the fading of dyes and the deterioration of resins constituting the film will be extremely small. On the other hand, no further effect could be obtained even if the stabilizer is added in an amount of more than 1 weight %.

The fluorescent whitening agent contained in the transfer layer of the protective member of the invention will absorb light in a wavelength region of 340 to 400 nm and emit light in a wavelength region of 400 to 500 nm to provide a fluorescent whitening effect.

The fluorescent whitening agent is contained generally in recording media for the purpose of improving the whiteness of the media. However, if a transfer layer which contains an ultraviolet light absorber and a light stabilizer is laminated on a recording medium, the ultraviolet light absorber absorbs a portion of light of a wavelength of 300–380 nm which would otherwise contribute to effective fluorescent whitening from the illuminating light, thus resulting in insufficiency of the fluorescent whitening effect in the recording medium. In this invention, the fluorescent whitening agent is incorporated in the transfer layer, thus improving the whiteness of the images.

The following compounds can be cited as suitable fluorescent whitening agents: derivatives of oxazole, triazole, biphenyl, imidazole, coumarin, pyrazoline, and naphthylimide. Particularly suitable compounds among them are oxazole compounds containing thiophene structure such as 2,5-bis[5'-tert-butylbenzoxazole(2)] thiophene; Whitex series (trade name, a product of Sumitomo Chemical); etc.

The content of the fluorescent whitening agent in layer 1a of the transfer layer of the protective member of the invention should be about 0.01 to 0.5 weight % based on the resin constituting the layer containing the fluorescent whitening agent. If the content is less than 0.01 weight %, yellowing of the white portion of print caused by the ultraviolet light absorber could not be suppressed.

The effect of each of the aforementioned ultraviolet light absorber, light stabilizer and fluorescent whitening agent can further be enhanced when they are used in combination with each other. In other words, light in a wavelength region of 300 to 380 nm which is absorbed by an ultraviolet light absorber is also absorbed partially by the fluorescent whitening agent. The light stabilizer will deactivate radicals which deteriorate image-forming dyes. This prevents radicals from deteriorating not only the image quality but also the resin material constituting the transfer layer. It will also prevent deterioration of both the ultraviolet light absorber and fluorescent whitening agent.

The transfer layer after it is transferred onto a recorded image as shown in FIGS. 1 and 2 has such a layer structure that the light illuminating the image will be introduced into the fluorescent-whitening-agent-containing layer without passing through the ultraviolet-light-absorber-containing layer. Therefore, sufficient light required for whitening is supplied to the fluorescent-whitening-agent-containing layer which does not contain the ultraviolet absorber. Thus, less fluorescent whitening agent is needed to provide a sufficient whitening effect. For example, the protective member of the invention can give approximately the same effect with the fluorescent whitening agent content of 1/10 that of the layer containing both a fluorescent whitening agent and an ultraviolet light absorber.

In the event the ultraviolet light absorber is not compatible with the light stabilizer, the absorber and the stabilizer are preferably incorporated respectively into separate layers. In this case, the layer containing the light stabilizer should be placed in the position farthest from substrate 1 so that this layer will contact the surface of the recording medium after the transfer to protect the recorded images from radicals.

The thickness of the protective transfer layer of the invention should be in a range of substantially 1 to 100 μm. In practice, the layer has most preferably a thickness ranging from 5 to 50 μm.

The embodiment of this invention is by no means limited to examples of the protective member as shown in FIGS. 1 and 2. The protective member may include a resin undercoat layer inserted between substrate 2 and layer 1a.

Figure 3A:
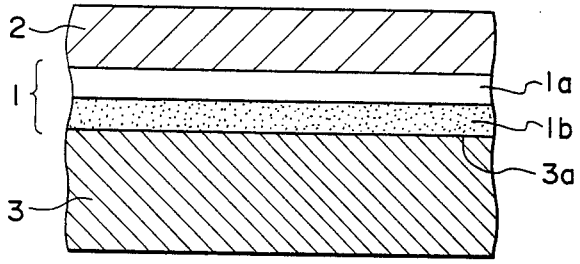
FIGS. 3A and 3B are charts illustrating the process of lamination of a print using the protective member of the invention, showing partial cross sectional views of the print to be processed and the protective material to be used.

The protective member of the invention described above, for example the one shown in FIG. 1, may be used for lamination of prints in the following manner as shown in FIG. 3A. First, the protective member of the invention is superposed on recorded image surface 3a of print 3 which has been formed by a recording process such as an ink jet recording process with a recording liquid which contains aqueous dyes.

In this step, recorded image 3a of the print must be placed in such a position that it is directly covered by transfer layer 1 of the protective member of the invention. Next, lamination process is performed with a lamination device provided with a pressure roller or the like, and the protective member of the invention is deposited on the print under heat and pressure by way of lamination of transfer layer 1 over recorded image surface 3a. Through this process, transfer layer 1 is applied to recorded image surface 3a of print 3.

Conditions such as pressure and temperature for the thermal lamination must be selected according to the type of material of the transfer layer so that the surface of the transfer layer will fuse and adhere to the recorded image surface.

Figure 3B:
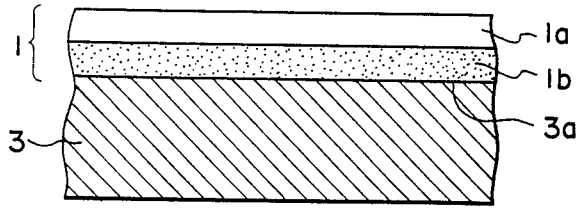

Subsequently, with transfer layer 1 being adhered effectively onto recorded image surface 3*a*, substrate 2 is released from transfer layer 1, leaving only transfer layer 1 on recorded image surface 3*a* as shown in FIG. 3B, thus completing the lamination.

Any prints may be used for this invention so long as they are recorded matters formed by using dyes, irrespective of the forming process used. In other words, aside from the ink jet process, prints may be produced by any of the heat-sensitive transfer systems, heat-sensitive sublimation recording systems, etc.

The invention will be further described in detail with reference to Example below.

EXAMPLE 1

| | |
|---|---|
| Clear paint A: (composition) | |
| Dianal LR-216 (trade name of a product supplied by Mitsubishi Rayon K.K., a 40% toluene solution of an acrylic resin) | 100 weight parts |
| Tinuvin 320 (trade name of an ultraviolet light absorber supplied by Ciba Geigy) | 1 weight part |
| Tinuvin 144 (trade name of a light stabilizer supplied by Ciba Geigy) | 0.2 weight part |
| Clear paint B: (composition) | |
| Dianal LR-216 (trade name of a 40% toluene solution of acrylic resin) | 100 weight parts |
| Uvitex OB (trade name of a fluorescent whitening agent supplied by Ciba Geigy) | |

Clear paint B having the above composition was applied to obtain a dried film thickness of 15 μm onto a 50 μm-thick PET (polyethylene terephthalate) film by using a bar coater (#25). After drying the coat, clear paint A having the above composition was applied onto this coat in the same manner and dried to form a 30 μm-thick, transfer layer of a two-layer structure on the PET film, thereby obtaining a transfer release type of protective member of the invention.

Next, using a color ink jet printer, PJ-1080 (manufactured by Canon K.K.), solid printing of magenta color was carried out on an ink jet recording paper. Then, the protective member of the invention, which had been prepared earlier, was laminated so that its transfer layer covered the PET film. Then, the PET film was released from the printed surface and laminated sample 1 was obtained.

EXAMPLE 2

| | |
|---|---|
| Clear paint C: (composition) | |
| Dianal LR-469 (trade name of a product of Mitsubishi Rayon, 40% toluene MEK solution of acrylic resin) | 100 weight parts |
| Uvinal D-49 (trade name of an ultraviolet light absorber supplied by BASF) | 1.5 weight parts |
| Clear paint D: (composition) | |
| Dianal LR-469 (trade name of a product supplied by Mitsubishi Rayon, 40% toluene MEK solution of acrylic resin) | 100 weight parts |
| Sanol LS 770 (trade name of light stabilizer supplied by Ciba Geigy) | 0.2 weight part |
| Clear paint E: (composition) | |
| Dianal LR-469 (trade name of a product of Mitsubishi Rayon, 40% toluene MEK solution of acrylic resin) | 100 weight parts |
| Uvitex OB (trade name of an ultraviolet light absorber supplied by Ciba Geigy) | 0.1 weight part |

Clear paint E of the above composition was applied over a 50 μm-thick PET (polyethylene terephtalate) so as to obtain a dried film thickness of 15 μm, using a bar coater (#25). After drying the coat, clear paint C was applied to obtain a dried film thickness of 10 μm in the same manner. Further, clear paint D was applied to form a transfer layer of 30 μm in thickness. Thus, the transfer and release type of the protective member of the invention was obtained.

Further, laminated sample 2 was obtained in the same manner that was used for Example 1.

EXAMPLE 3

| | |
|---|---|
| Clear paint F: (composition) | |
| Dianal LR-216 (trade name of a product supplied by Mitsubishi Rayon 40% toluene solution of acrylic resin) | 100 weight parts |
| Tinuvin 900 (trade name of an ultraviolet light absorber supplied by Ciba Geigy) | more than 10 weight parts |
| Tinuvin 144 (trade name of a light stabilizer supplied by Ciba Geigy) | 0.5 weight part |
| Clear paint G: (cmposition) | |
| Dianal LR 216 (trade name of a product supplied by Mitsubishi Rayon K.K., 40% toluene solution of acrylic resin) | 100 weight parts |
| Uvitex OB (trade name of an ultraviolet light absorber supplied by Ciba Geigy) | 1 weight part |

Clear paint G of the above composition was applied over a 50 μm-thick PET (polyethylene terephthalate) film so as to obtain a dried film thickness of 10 μm, using a bar coater (#25). After drying the coat, clear paint F of the above composition was applied over this coat in the same manner. Upon drying, a 30 μm-thick transfer layer having a two-layer structure was formed on the PET film. Thus, the transfer-release type of protective member of the invention was obtained. Further, lamination sample 3 was obtained in the same manner as in Example 1.

EXAMPLE 4

| | |
|---|---|
| Clear paint H: (composition) | |
| S-lec BL-S (trade name of a product supplied by Sekisui Chemical, a 40% toluene solution of butyral resin) | 100 weight parts |
| Tinuvin 328 (trade name of an ultraviolet light absorber supplied by Ciba Geigy) | 1.5 weight parts |
| Tinuvin 144 | 0.5 weight part |

-continued

| | |
|---|---|
| (trade name of a light stabilizer supplied by Ciba Geigy) | |
| Clear paint I: (composition) | |
| Dianal LR-216 (trade name of a product supplied by Mitsubishi Rayon, a 40% toluene solution of an acrylic resin) | 100 weight parts |
| Uvitex OB (trade name of an ultraviolet light absorber supplied by Ciba Geigy) | 0.1 weight part |

Clear paint I of the above composition was applied over a 50 μm-thick PET (polyethylene terephtalate) film so as to obtain a dried thickness of 10 μm by employing a bar coaster (#25). After drying the coat, clear paint H of the above composition was applied over this coat in the same manner. Upon drying, a 30 μm-thick transfer layer having two-layer structure was formed over the PET film. Thus, a transfer-release type of protective member of the invention was obtained.

Further, lamination sample 4 was obtained in the same manner as in Example 1.

EXAMPLE 5

| | |
|---|---|
| Clear paint J: (composition) | |
| S-lec BL-1 (trade name of a product supplied by Sekisui Chemical, a 40% toluene-MEK solution of butyral resin) | 100 weight parts |
| Tinuvin 900 (trade name of an ultraviolet light absorber supplied by Ciba Geigy) | 2 weight parts |
| Clear paint K: (composition) | |
| Dianal LR-469 (trade name supplied by Mitsubishi Rayon, a 40% toluene-MEK solution of an acrylic resin) | 100 weight parts |
| Sanol LS 622LD (trade name, a light stabilizer supplied by Ciba Geigy) | 0.5 weight part |
| Clear paint L: (composition) | |
| Dianal LR-469 (trade name, a product supplied by Mitsubishi Rayon, a 40% toluene-MEK solution of acrylic resin) | 100 weight parts |
| Uvitex OB (trade name, a fluorescent whitening agent supplied by Ciba Geigy) | 0.1 weight part |

Clear paint L of the above composition was applied over a 50 μm-thick PET (polyethylene terephthalate) film so as to obtain a dried film thickness of 10 μm by employing a bar coater (#25). After drying the coat, clear paint J of the above composition was applied over the coat on the PET film so as to obtain the dried thickness of 10 μm. Further, clear paint K of the above composition was applied over the coat in the same manner to form a 30 μm-thick transfer layer. Thus, the transfer-release type of protective member of the invention was obtained.

Further, lamination sample 5 was obtained in the same manner that was used for Example 1.

COMPARISON EXAMPLE 1

| | |
|---|---|
| Clear paint M: | |

-continued

| | |
|---|---|
| (composition) | |
| Dianal LR-472 (trade name, a product supplied by Mitsubishi Rayon, a 40% toluene solution of an acrylic resin) | 100 weight parts |
| Sumisorb 90 (trade name, an ultraviolet light absorber supplied by Sumitomo Chemical) | 0.8 weight part |
| Clear paint N: (composition) | |
| Dianal LR-472 (trade name, a product supplied by Mitsubishi Rayon, a 40% toluene solution of an acrylic resin) | 100 weight parts |
| Uvitex OB (trade name of a fluorescent whitening agent supplied by Ciba Geigy) | 0.1 weight part |

Clear paint N of the above composition was applied over a 50 μm-thick PET (polyethylene terephthalate) film to a dried film thickness of 15 μm, using a bar coater (#25). After drying the coat, clear paint M was applied over this coat in the same manner. Upon drying, a 30 μm-thick transfer layer having two-layer structure was formed on the PET film. Thus, the transfer-release type of protective member of the invention was obtained.

Further, lamination sample 6 was obtained in the same manner as in Example 1.

COMPARISON EXAMPLE 2

Lamination sample 7 was obtained in the same manner as in Example 1 except that clear paint B was not applied and instead only clear paint A was applied over the PET film to a dried film thickness of 30 μm.

COMPARISON EXAMPLE 3

The protective member was formed in the same manner as in Example 2 except that clear paint E was not applied and instead clear paints C and D were applied in that order over the PET film so as to obtain a respective dried thickness of 15 μm. Then, lamination sample 8 was obtained in the same manner as in Example 1.

COMPARISON EXAMPLE 4

The protective member was formed in the same manner as in comparison example 1 except that clear paint N was not applied and instead only clear paint M was applied over the PET film to a dried thickness of 30 μm. Then, lamination sample 9 was obtained in the same manner as for embodiment 1.

Each lamination samples 1 to 9 that were obtained in Examples 1 to 5 and Comparison examples 1 to 4 was tested and evaluated for the following two characteristics. The results obtained are shown in Table 1.

(1) Whiteness:

The whiteness of the area left blank on the recording paper was visually compared, after the lamination treatment by the protective member, with that of a corresponding portion before the treatment. (i.e. comparison between an area on the recording paper which is covered with the transfer layer and an area left uncovered). The recording paper on which whiteness was not effected by the lamination process was marked (○). The recording paper whose protected areas were slightly colored yellow by the lamination process was marked (Δ). The recording paper with substantially yellowed areas was marked (x). (2) Resistance to light:

The samples were exposed to light ($I=0.92$ w/m$^2$, 420 nm) for 20 hours in a xenon fade meter and the color difference $\Delta E^*$ ($L^*a^*b^*$ colorimetric system) in an area printed in magenta color before and after exposure to radiation was measured. Measurement results were evaluated as follows:

In case $\Delta E^* \leqq 6$, marked with a symbol ◎, $6 \leqq \Delta E^* \leqq 10$, marked with a symbol ○, $10 < \Delta E^* \leqq 20$, and marked with a symbol Δ, $20 < \Delta E^*$, marked with a symbol x.

In the test of resistance to light, Atlas Ci35 (Xenon Weather-O-Meter) (trade name of a product of Atlas) was used for light irradiation. The color was measured by a color pack system which used Spectrophotometer UV-240 (Shimadzu Seisakusho).

TABLE 1

| | | Lamination sample No. | Whiteness | Resistance to weathering |
|---|---|---|---|---|
| Example | 1 | 1 | ○ | ◎ |
| | 2 | 2 | ○ | ◎ |
| | 3 | 3 | ○ | ◎ |
| | 4 | 4 | ○ | ◎ |
| | 5 | 5 | ○ | ◎ |
| Comparison example | 1 | 6 | ○ | Δ |
| | 2 | 7 | x | ○ |
| | 3 | 8 | x | ○ |
| | 4 | 9 | x | x |

As described in detail in the foregoing, use of the protective member of the invention will simplify the lamination process for recorded images on the print. Protection of recorded images by the transfer layer of the protective material of the invention provides the images with various properties including resistance to water, solvents and abrasion.

Particularly, the transfer layer of the protective member of the invention contains at least an ultraviolet light absorber, a light stabilizer and a fluorescent whitening agent. Of the spectrum of light penetrating the transfer layer, both the ultraviolet stabilizer and the fluorescent whitening agent will effectively absorb and intercept light in a wavelength range of 300 to 380 nm, which causes deterioration of dyes that forms images. This will protect images covered by the transfer layer from light in such undesirable wavelength regions. As a result, the light resistance of images can greatly be improved.

Moreover, the layer containing the fluorescent whitening agent is made an independent layer free from the ultraviolet light absorber. This will allow the fluorescent whitening agent to effectively function, and makes it possible to fully retain the whiteness of recorded material and reduce the quantity of the fluorescent whitening agent. A gloss can also be given to the surface of the transfer layer positioned over the images by incorporating additives into this layer, thereby transforming it into a glossy layer. This will provide an easy and simple means to provide a gloss on the print surface even if the original recording material is a porous, lusterless material. The gloss will increase the sharpness of images and enhance the refined quality of the images.

Radicals may be formed by ultraviolet light not absorbed by the ultraviolet light absorber or due to any other causes. The light stabilizer contained in the transfer layer will deactivate such radicals. This will effectively eliminate the deterioration of image quality caused by radicals, and prevent the transfer layer from deteriorated by radicals. Accordingly, the effect of the ultraviolet light absorber and the fluorescent whitening agent will not be diminished.

The ultraviolet light absorber and the light stabilizer can be provided as two separate layers in applications where both stabilizers are incompatible with each other.

Further, the transfer layer can be formed so that its shrinkage due to thermal process will not be substantially different from the shrinkage of the print. This will permit the lamination process to be performed on only one side of the recording material (the image-bearing side) without causing the material to curl. This in turn will contribute to preventing deterioration of recorded images.

The lamination of one-side of the print permits a less volatile component other than a dye, such as a solvent, of a recording liquid which causes discoloration or feathering of the print to evaporate gradually from the back side of the print, thus preventing the deterioration of the recorded picture caused by the component remaining in the picture. Accordingly, even a recorded image which has not been fixed for a sufficient time can immediately be used by laminating it with the protective member of the present invention.

We claim:

1. A protective article comprising a substrate and a transfer member provided releasably thereon, said transfer member comprising a plurality of layers including at least a fluorescent whitening agent, an ultraviolet light absorber, and a light stabilizer, wherein said light stabilizer is located in a layer furthest from said substrate, wherein the layer furthest from said substrate is composed of a material that will adhere to a surface to be protected by said protective article.

2. The article defined by claim 1, wherein said transfer member comprises a layer containing said ultraviolet light absorber and said light stabilizer, and a layer containing said fluorescent whitening agent.

3. The article defined by claim 2, wherein said layer containing the fluorescent whitening agent is either adjacent to or in close proximity to said substrate.

4. The article defined by claim 2, wherein said ultraviolet light absorber layer comprises a resin, wherein said ultraviolet light absorber comprises from 0.5 to 12.0 weight % of said resin.

5. The article defined by claim 2, wherein said light stabilizer layer comprises a resin, wherein said light stabilizer comprises from 0.01 to 1 weight % of said resin.

6. The article defined by claim 2, wherein said fluorescent whitening agent layer comprises a resin, wherein said fluorescent whitening agent comprises from 0.01 to 1 weight % of said resin.

7. The article defined by claim 1, wherein said transfer member comprises a layer containing said ultraviolet light absorber, a layer containing said light stabilizer, and a layer containing said fluorescent whitening agent.

8. The article defined by claim 7, wherein said layer containing the fluorescent whitening agent is either adjacent to or in close proximity to said substrate, and the layer containing said light stabilizer is located furthest from said substrate.

9. The article defined by claim 7, wherein said ultraviolet light absorber layer comprises a resin, wherein said ultraviolet light absorber comprises from 0.5 to 12.0 weight % of said resin.

10. The article defined by claim 7, wherein said light stabilizer layer comprises a resin, wherein said light stabilizer comprises from 0.01 to 1 weight % of said resin.

11. The article defined by claim 7, wherein said fluorescent whitening agent layer comprises a resin, wherein said fluorescent whitening agent comprises from 0.01 to 1 weight % of said resin.

12. The article defined by claim 1, wherein the thickness of said transfer member ranges from 1 to 100 μm.

13. The article defined by claim 1, wherein the thickness of said transfer member range from 5 to 50 μm.

14. The article defined by claim 1, wherein said light stabilizer comprises means for deactivating radicals formed in said transfer member and on said surface.

15. The articled defined by claim 1, wherein said light stabilizer comprises a material selected from the group consisting of:

bis-(2,2,6,6-tetramethyl-4-piperidyl)sebacate; bis-(1,2,2,6,6-pentamethyl-4-piperidyl)sebacate; succinic acid dimethyl-1-(2-hydroxyethyl)-4-hydroxy-2,2,6,6-tetramethyl piperidine polycondensate; poly[[6-(1,1,3,3-tetramethylbutyl)imino-1,3,5-triazine-2,4-diyl]-[(2,2,6,6-tetramethyl-4-piperidyl-)imino]hexamethylene [(2,2,6,6-tetramethyl-4-piperidyl)imino]]; and hindered amine compounds.

16. A protective layer according to claim 15, wherein said member is adapted to protect an image produced by ink-jet recording.

17. The article defined in claim 1, wherein said material is adapted to adhere to said surface in response to the application of heat and pressure to said material on said surface.

18. The article defined by claim 17, wherein said material fuses with said surface in response to said application of heat and pressure.

19. The article defined by claim 18, wherein said transfer member has substantially the same shrinkage ratio in response to said application of heat as said surface.

20. The article defined by claim 1, wherein said member is composed of a thermoplastic resin selected from the group consisting of:

ethyl cellulose, vinyl acetate resin, and their derivatives, polystyrene polyethylene, ethylene-vinyl acetate copolymers, acrylic resins, polystyrene and their copolymers, polyisobutylene, hydrocarbon resins, polypropylene, polyamide resins, and polyester resins.

* * * * *

UNITED STATES PATENT AND TRADEMARK OFFICE

CERTIFICATE OF CORRECTION

PATENT NO. : 4,756,963

DATED : July 12, 1988

INVENTOR(S) : MAYUMI YAMAMOTO, ET AL.

It is certified that error appears in the above-identified patent and that said Letters Patent is hereby corrected as shown below: ON THE TITLE PAGE:

AT [75] IN THE INVENTORS

"Reiko Yanagiba," should read --Rieko Yanagiba,--.

AT [56] IN REFERENCES CITED

U.S. Patent Documents,
"4,595,316 6/1986 Toganoh et al. ... 346/1.1" should read
--4,595,931 6/1986 Toganoh et al. ... 346/1.1--.

AT [57] IN THE ABSTRACT

Line 10, "picture" should read --print--.

COLUMN 11

Line 9, "$6 \leq \Delta E^* \leq 10$," should read --$6 < \Delta E^* \leq 10$,--.

COLUMN 13

Line 14, "articled" should read --article--.

UNITED STATES PATENT AND TRADEMARK OFFICE

CERTIFICATE OF CORRECTION

PATENT NO. : 4,756,963

DATED : July 12, 1988

INVENTOR(S) : MAYUMI YAMAMOTO, ET AL.

It is certified that error appears in the above-identified patent and that said Letters Patent is hereby corrected as shown below:

COLUMN 14

Line 1, "A protective layer according" should read --The article defined--.

Signed and Sealed this

Thirty-first Day of January, 1989

*Attest:*

*Attesting Officer*

DONALD J. QUIGG

*Commissioner of Patents and Trademarks*